US005441161A

United States Patent [19]

Merl

[11] Patent Number: 5,441,161

[45] Date of Patent: Aug. 15, 1995

[54] PEG CONSTRUCTION FOR PEGBAR DISPLAYS

[75] Inventor: Milton J. Merl, Stonington, Conn.

[73] Assignee: Milton Merl & Associates Inc., New York, N.Y.

[21] Appl. No.: 145,797

[22] Filed: Nov. 1, 1993

[51] Int. Cl.[6] ..... A47F 5/00

[52] U.S. Cl. ..... 211/57.1; 211/59.1

[58] Field of Search ..... 211/57.1, 54.1, 59.1; 248/220.4, 220.3, 221.1

[56] References Cited

U.S. PATENT DOCUMENTS

| | | | |
|---|---|---|---|
| 3,486,632 | 12/1969 | Balch . | |
| 3,815,756 | 6/1974 | Cox | 211/57.1 |
| 3,986,613 | 10/1976 | Mayer | 211/57 |
| 4,606,466 | 8/1986 | Fredrickson | 211/59.1 |
| 4,616,753 | 10/1986 | Aslan | 211/57.1 |
| 5,014,949 | 5/1991 | Niven | 211/57.1 X |
| 5,236,163 | 8/1993 | Valuilis | 211/57.1 X |

*Primary Examiner*—Leslie A. Braun
*Assistant Examiner*—Sarah L. Purol
*Attorney, Agent, or Firm*—Schwetizer Cornman & Gross

[57] ABSTRACT

A multi-level peg assembly for attachment to a pegbar having a predetermined width, such assembly comprising: an elongated peg wire bent to provide a horizontal spine, a vertical back peg hangar depending from the rearmost portion of said spine, a front peg hanger depending from the forwardmost portion of said spine, a back peg extending forwardly from said back peg hanger, and a front peg extending forwardly from said front peg hanger; said spine, hangers, and pegs all being disposed in a common plane; a pair of rigidifying wires disposed in tandem and in association with said spine; said rigidifying wires each having vertical mounting legs depending from rearmost portions thereof; said vertical mounting legs being spaced from said back peg hanger a predetermined distance substantially equal to the width of the pegbar; detent locking means formed integrally with lower portions of said mounting legs; a C-shaped bracket having a horizontal top wall and a horizontal bottom wall joined by a front wall; a first elongated slot formed in said top wall and a second elongated slot formed in said bottom wall; a vertical slot formed in said front wall; whereby said peg wire may be mounted to said pegbar by superpositioning said C-shaped bracket over said pegbar, inserting said mounting legs through said horizontal slots to permit said detent locking means to engage said second slot and to permit said vertical bank hanger to engage said vertical slot.

7 Claims, 3 Drawing Sheets

PEG CONSTRUCTION FOR PEGBAR DISPLAYS

BACKGROUND OF THE INVENTION

1. Field of the Invention

This invention pertains to improved pegbar display devices, and more particularly, to multi-task, in-line pegs, especially adapted to hold more inventory by increasing available hanging length and for "splitting" or dividing displayed inventory between front and back locations providing two stockkeeping units (SKU) at each facing or peg site of the pegbar. This maximizes cold space volume use for refrigerated display units.

2. Prior Art

Peg bars are typically employed in businesses that retail groceries, specifically supermarkets, grocery stores and convenience stores. They are used to great advantage in refrigerated cases to merchandise prepackaged sliced cheese and meats. Peg bars are also used for displays of other blister packed goods or carded products.

The standard pegbar comprises a transverse structural bar fastened to a wall support. The structural bar functions as a beam for cantilevered pegs which are supported in holes or slots formed along the length of the bar. A typical pegbar used in the food industry is disclosed in Mayer U.S. Pat. No. 3,986,613. Other pegbar displays used in the food field and elsewhere are shown in U.S. Pat. Nos. 4,666,466 and 3,486,632.

Close vertical spacing of pegbars above one another is very important to retailers. Location of the pegbars as closely as possible, permits more horizontal rows of goods to be displayed in a finite merchandising wall area (shelf, refrigerator, floor). The sag of known pegbars, including those described in the aforementioned patents, requires that the pegbars be spaced apart a distance equal to individual package height plus clearance and allowance for sag of the pegs. The cumulative sag of stacked pegs reduces the number of rows of display and hanging of merchandise.

Existing pegbar displays and merchandising systems include provision for display of pricing, ad copy, bar code information and pricing specials. Industry practice has been to utilize label holders on shelving above, below or to a side of the pegbar display, as well as label holders or I.D. (identification) bars associated directly with individual pegs.

FEATURES OF THE INVENTION

The present invention offers retailers and manufacturers space and labor-saving improvements in contrast with earlier systems and offers better and more efficient use of available, expensive cold space volume. Retailers have limited space in which to inventory and to display the constantly growing assortment of new products, particularly refrigerated foods. This is a particular problem in the peg cheese and prepared meat category in view of the introduction of numerous new products that address low-fat or fat-free lifestyles and/or fast, easy, and convenient preparation, The new multi-task peg adds both inventory and available SKU (selection) locations within a defined or limited display space by allowing for deeper inventory per facing, as well as offering a split inventory or two SKU's per face option.

SUMMARY OF THE INVENTION

Available pegs do not presently exceed 16"0 of usable space because if they are made longer, they tend to bend under load of displayed goods. The multi-task pegs of the new invention can be built to match the depth of any typical dairy case, averaging 24". This represents a 33% improvement in available display length in comparison to that provided by existing pegs.

Current peg systems are typically positioned on $\frac{7}{8}$" horizontally spaced centers. The new pegs of the present invention are adapted to slide along the pegbar to enable tighter packing of facings and infinite adjustment between adjacent pegs. Therefore, more of the new pegs and more SKU locations and more displayed inventory may be accommodated with the present invention.

Current peg systems employ a fixed UPC tag channel placed over the top of a row of pegs. This is unsightly and spatially inefficient. The new multi-task peg incorporates its own individual UPC holder placed at the front of the peg which UPC holder may be rotated out of the way when desired. This offers greater visibility and improved spatial efficiency.

Current peg systems are limited to displaying one SKU per facing due to fixed center spacing. The new peg system of the present invention allows two, or even three SKU's per facing through the addition of one or two hook divisions. This is extremely valuable to retailers who are concerned with creating efficient inventories of products; typically, all SKU's within a category do not sell at the same rate. The new peg system allows high volume SKU products to be stored on the back peg(s), while a slower moving product occupies the front. This permits retailers to offer consumer-demanding selection and to eliminate costly "out of stocks" of popular fast-selling products and "over stocks" of less popular slow-selling products.

In order to rotate products to insure the sale of the older inventory prior to their expiration dates, shelf stockers must extract current peg systems and load new product on the back or move product from one peg to a neighboring one. This is often a difficult, if not impossible task because of product weight or the unavailability of a neighboring peg. The new peg of the present invention allows simple, fast rotation of stock from the back peg to the front.

The multi-task peg of the present invention may be constructed in two preferred embodiments. In the first, a simple double in-line peg member is reinforced by two side wires between which the double-in-line peg is sandwiched in a "beam" type construction. The back ends of the side wires are configured to provide a "snap-on" connection to the pegbar; the front end of one side wire provides I.D. display.

An alternative preferred embodiment employs a draw slide-like mechanism to assist in loading, combined with the double in-line peg.

Both new multi-task peg assemblies are designed to snap over existing 1"×1½" pegbars installed with traditional hooks. Such pegbars are disclosed in U.S. Pat. No. 4,606,466.

For a better understanding of the invention and for an appreciation of its advantages, reference should be made to the following detailed description of the invention, taken in conjunction with the accompanying drawings.

DETAILED DESCRIPTION OF THE INVENTION

The components of the new multi-task pegs 10 are designed to be manufactured with inexpensive, retail-compatible, cold-rolled, mild steel wire and sheet. Moreover, and as will be understood, each basic component may be fabricated simply and with a minimum expense. The assembly of the new peg requires a minimum of labor. Thus the finished product is highly cost-effective to manufacture.

The components are arranged and joined to maximize the strength of the entire assembly. The prior use of a single wire of maximum diameter of 9/32", (which would pass through standard peg holes) was not stiff enough to support 24" of cheese or other heavy products. However, in accordance with the present invention, a peg is divided into two or more increments to create 12" lengths which are each stiff enough to support the divided load portions.

Figure 1:
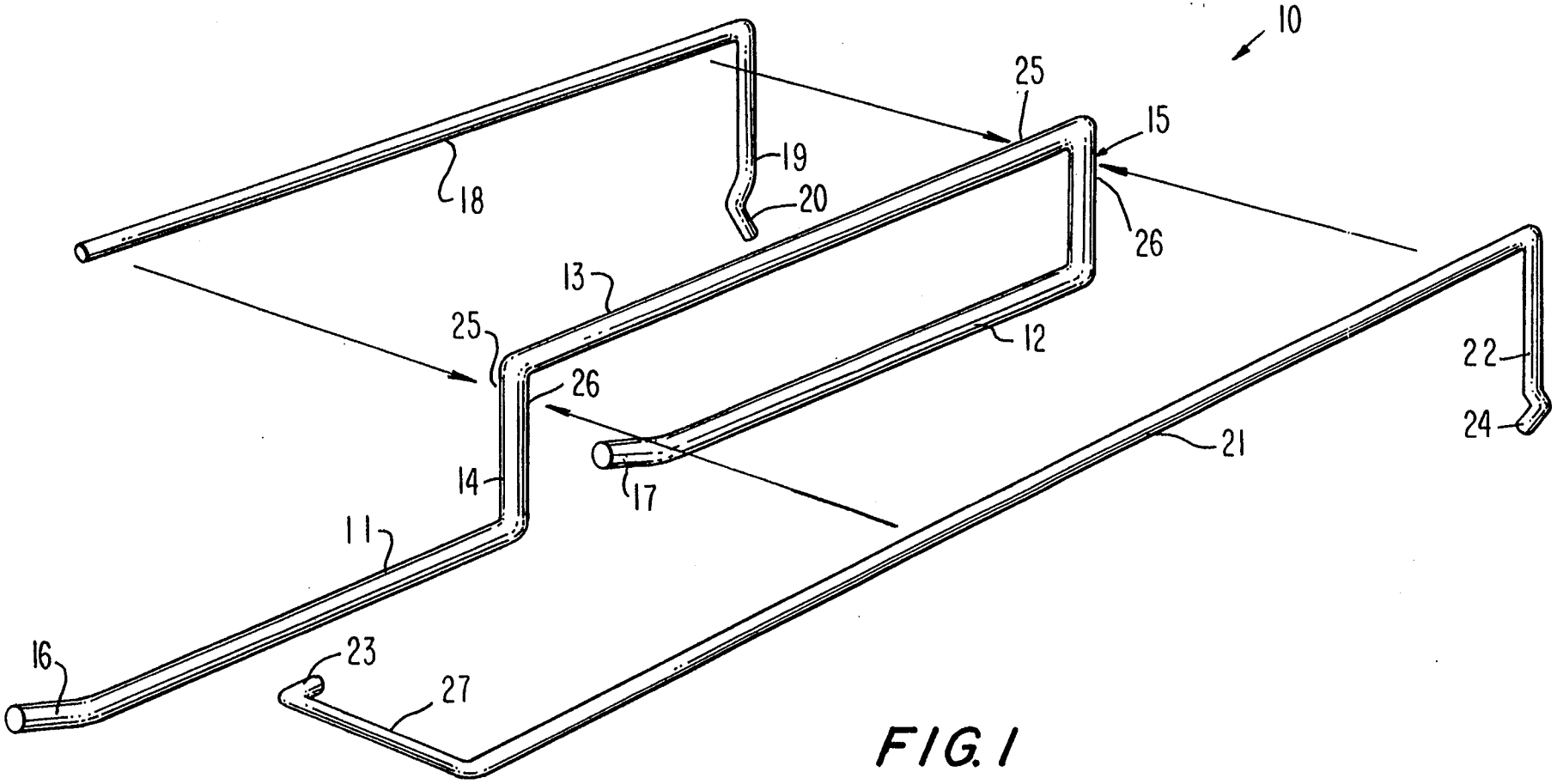
FIG. 1 is an exploded perspective view of the elements of the new multi-taskpeg.

Referring now to FIG. 1 in a preferred embodiment of the present invention, a new and improved peg is formed by bending a 9/32" diameter wire of substantial length to form, from a single bent element, a front peg portion 11 which is separated from and in a line with a back peg element 12. The front and back peg elements are hung from a peg spine 13 by a front vertical hanger element 14 and a back vertical hanger element 15. Both the front and the back pegs have forwardly, upwardly cantered peg nose portions 16, 17, respectively. In accordance with the principles of the invention, the spine 13 is reinforced by a stiffening wire 18 which is cantilevered from a vertical mounting leg 19 which is formed from bent 3/16" diameter wire and which terminates in a V-shaped detent 20. In accordance with the invention, the spine 13 and the in-line front and back pegs which are integrally suspended therefrom are further stiffened and reinforced by an additional wire 21 which extends forwardly from a second mounting leg 22 to a point slightly ahead of the peg nose 16 and which wire 21 supports a label support leg 27 at its front end as shown. A stop arm 23 is formed at the end of the label support leg 27 as shown. The mounting leg 22 for the wire 21 terminates in a locking detent 24 which is identical in shape to the detent 20 formed on the first mounting leg 19.

The wires 18 and 21 sandwich the bent in-line pegs and are joined thereto by welds (not shown) at points 25 and 26 where the wires contact one another. In accordance with the invention, this preferred embodiment of the double in-line peg is in the form of a beam construction which is achieved by the sandwiching of the double in-line peg member by the stiffener and I.D. label support wires 18 and 21. The stiffening wires, in addition to forming a beam construction with the double in-line peg member, provide mounting legs which enable the double in-line peg to be connected to a pegbar support as will be described hereinafter.

Figures 2, 3:
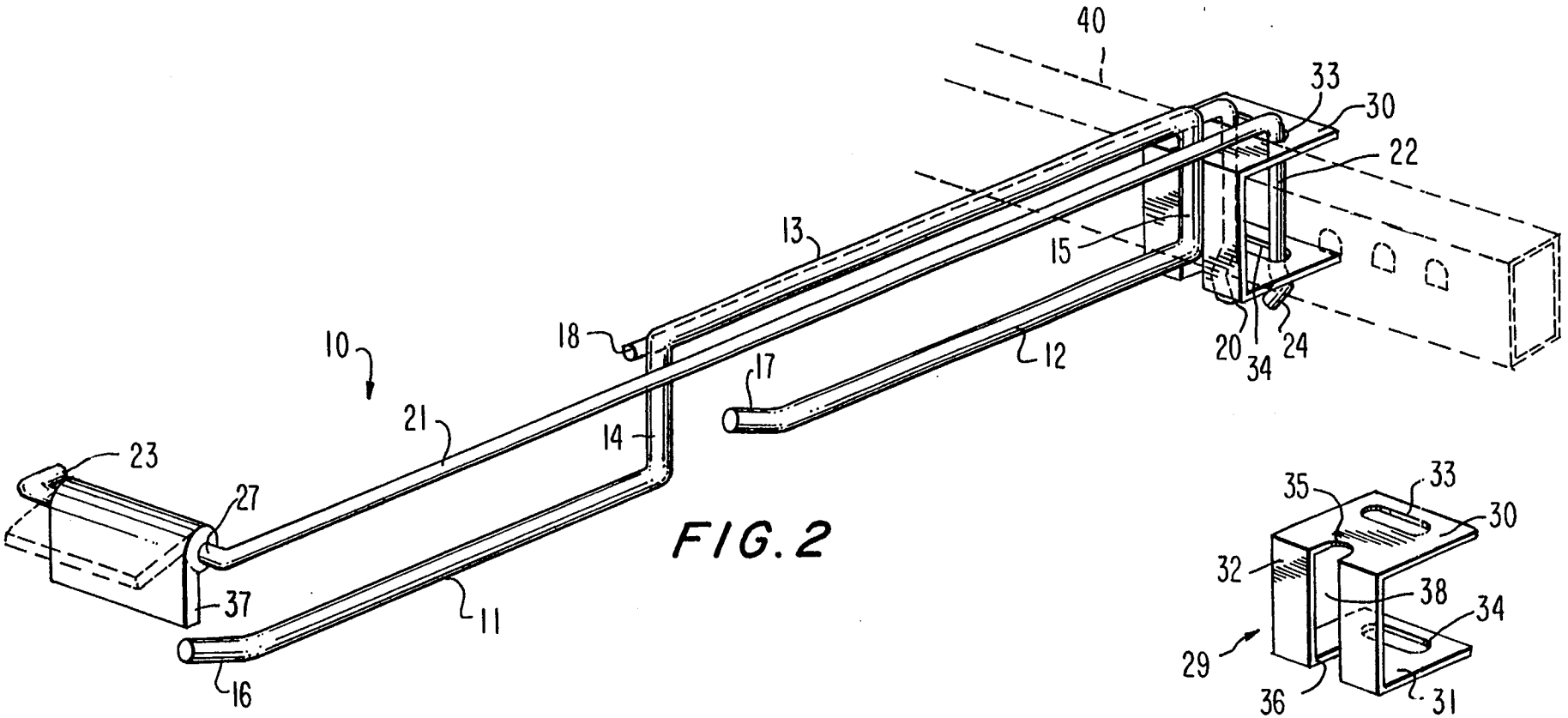
FIG. 2 is is a perspective view of one embodiment of the assembled peg in association with a pegbar.
FIG. 3 is a perspective view of a C-shaped assembly bracket for the peg and side wire.

Referring now to FIG. 3, a C-shaped mounting bracket 29 for the double in-line peg assembly 10 includes an upper horizontal wall 30 and a parallel bottom wall 31 interconnected by a front wall 32. The upper wall has an elongated locking slot 33 of elliptical configuration, the width of which is slightly greater than the sum of the diameters of the wire portions 15, 19 and 22, that is slightly greater than 21/32". A similar slot 34 is formed in the bottom wall of the clip as shown in FIG. 3. Two semicircular notches 35,36 are formed in the top and bottom walls respectively for the purpose of receiving the back peg hanger portion 15 as will be understood. The notches are joined by an intermediate vertical slot 38 in the front wall 32. The spacing of the innermost portion of the notches 35 and 36 from the slots 33 and 34 is equal to the width of the peg bar 40 from which the new peg is to be supported, typically 1" as illustrated.

To hang the new multi-task, double in-line peg at any point along a pegbar 40, the C-bracket 29 is introduced horizontally at the site (SKU) where the double in-line hook is to be supported. The top and bottom walls of the bracket are separated by the height of the pegbar, typically 1½ and will slide over the pegbar as will be appreciated. The bracket may be slid along the pegbar to another SKU if desired or necessary. With the bracket in its desired position, the double in-line peg assembly is merely dropped in and over the top wall of the bracket-with the vertical back peg hanger 15 engaging the notches 35 and 36 at the front of the bracket and the mounting legs 19 and 22 of the stiffening wire and the I.D. wire passing through the slots 33, 34 until the detents 20 and 24 snap against and beneath the edges of the slot 34 and lock at that position. As will be understood, the wire used to form the legs 19 and 22 is resilient and the process may be reversed by squeezing legs 19, 22 to unlock the detents 20, 24 from slot 34 and to remove the pegbar from the bracket for relocation. As shown in FIG. 2, a product identification label 37 may be appropriately hung from the label support 27 at the front end of the I.D. or reinforcement wire 21.

Figure 4:
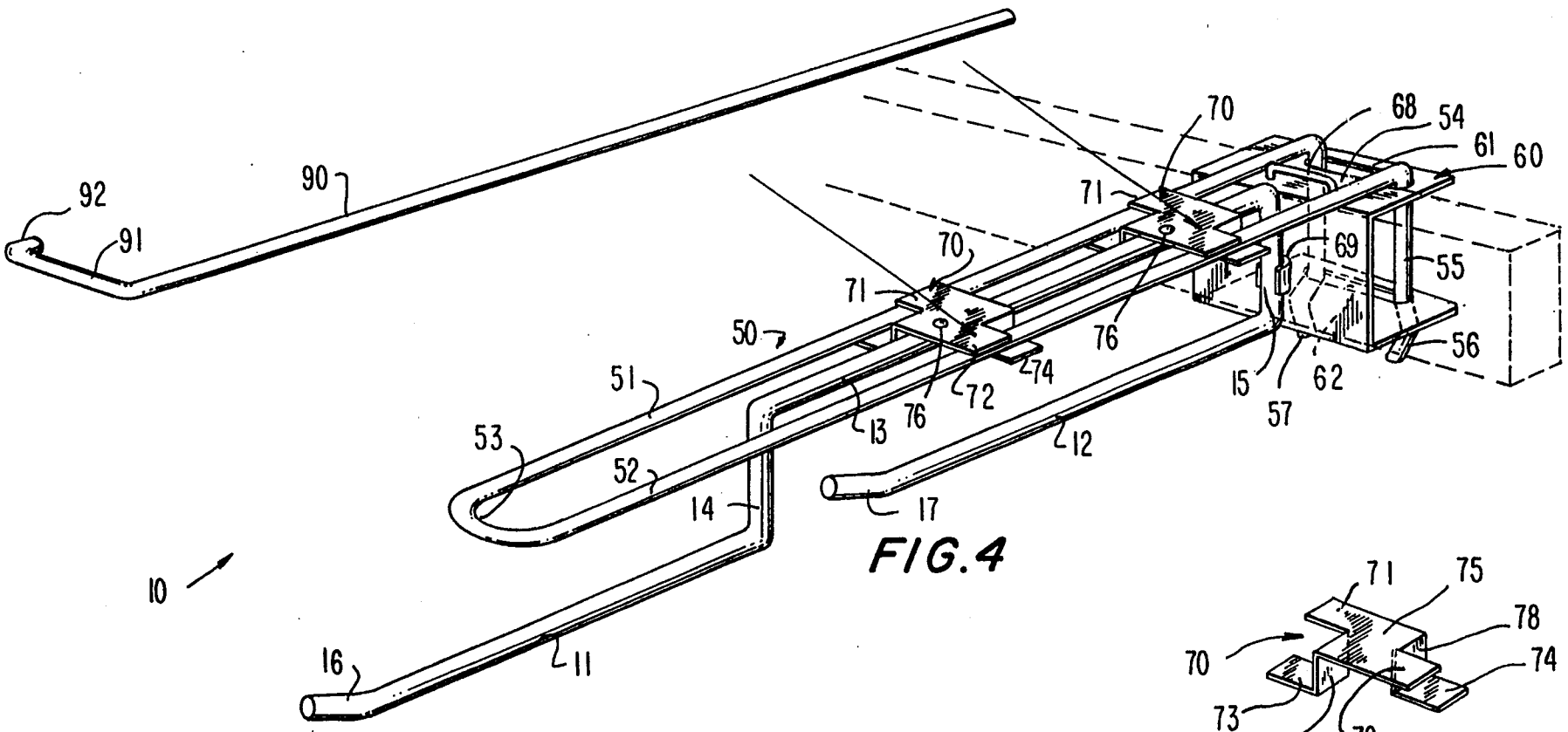
FIG. 4 is a perspective view of an alternate embodiment of the invention having a draw-slide mechanism to permit movement of the peg relative to the pegbar.

Referring now to FIG. 4, an alternate preferred embodiment of the present invention is illustrated. In this form, the double in-line peg is of the identical shape to that shown in FIG. 2 and like reference numerals will be used to designate like parts. However, in lieu of stiffening of the double in-line peg member by sandwiching wires 18 and 21, a "hairpin" slide wire 50 is employed, which hairpin includes a first leg 51, a second parallel leg 52 interconnected by a U-bend 53.

Figure 5:
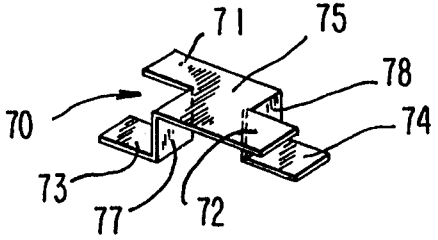
FIG. 5 is a perspective view of an assembly clip for the alternate embodiment.

In accordance with the principles of the invention, a pair of sliding clips 70 are welded to the spine 13 by welds 76. The clips 70 are formed from a single piece of sheet metal bent to have a top wall portion 75 and parallel bottom side walls 73, 74. Offset from the side walls 73, 74 and in the plane of the top wall 75 are top side walls 71, 72 as shown best in FIG. 5. The pairs of walls 72, 74 and 71, 73 engage the legs 51 and 52 of the hairpin slide wire. The vertical walls of the clip 70 which suspend the lower portions 73, 74 from the upper wall 75 are designated by reference numerals 77, 78 respectively. Thus, the double-in-line peg member supported by clips 70 is attached to the slide wire by means of the clips as shown in FIG. 4 for sliding movement forwardly and rearwardly along the legs 51 and 52. The forwardmost travel of the double-in-line peg will be limited by the engagement of the vertical front hanger 14 with the curved portion 53 of the slide wire, as will be understood. Similarly, the rearwardmost movement of the double-in-line peg along the slide wires 51 and 52 will be limited by the engagement of the vertical back peg hanger 15 with the bracket 60, the position illustrated in FIG. 4.

The bracket 60 which is used to mount the sliding double-in-line peg bar assembly to a pegbar is generally similar in function to that of the bracket 29 shown in FIG. 3. The bracket 60 includes an upper slot 61 and a parallel lower slot 62, the functions of which slots are analogous to the slots 33 and 34 of the bracket 29 illustrated in FIG. 3. That is to say, the detents 56 and 57 are engaged in the bottom slot 62 for locking the cantilevered double-in-line peg assembly to the pegbar. To remove the sliding double-in-line peg assembly, the detents 56, 57 are squeezed together to permit the removal of the legs 55, 54 through the slots 61, 62. To prevent inadvertent unlocking of the detents 56, 57, a spacer 68 is formed at the top surface of the bracket 60 to keep the legs 51, 52 of the slide wire spaced sufficiently apart to prevent inadvertent squeezing together to unlock the connection of the assembly to the bracket 60.

The vertical back peg hanger 15 of the double-in-line pegs engages the bracket 60 when the double peg wire is in its rearmost position. In both the FIG. 2 and FIG. 4 embodiments of the invention, it will be appreciated that the combination of side wires, either the wires 18 and 21 or the wires 51 and 52, wrapping around the pegbar by virtue of the mounting legs 19 and 22 or 54 and 55 in combination with the vertical back peg hanger 15 form a "U-shaped" section that fits and triangulates around the pegbar. The combined effect of the assembly is a strong mechanical marriage of components with minimal individual structured strengths, yet it is easy to assemble, to affix to a pegbar, and results in a combined structure that is capable of supporting the excessive loads imposed by the use of double-in-line pegs along a length that greatly exceeds the length of standard pegs.

An ID wire 90 having a label support 91 and a stop 92 may be fastened directly to the upper portions 72 of the clips 70 as indicated in FIG. 4. That fastening may be accomplished by welds, as will be understood. The ID wire 90 will thus slide along with the double-in-line pegs as they move along the slide wire by virtue of the support of the clips 70.

It should be particularly understood that the specific forms of the present invention herein illustrated and described are intended to be representative only (the dimensions included on the drawings being exemplary of the presently contemplated best modes), as certain changes may be made therein without departing from the clear teachings of the disclosure. Accordingly, reference should be made to the following appended claims in determining the full scope of the invention.

I claim:

1. A multi-level peg assembly for attachment to a pegbar having a predetermined width comprising:

(a) an elongated peg wire bent to provide a horizontal spine, a vertical back hanger element depending from the rearmost portion of said spine, a vertical front hanger element depending from a forward portion of said spine, a back peg element extending forwardly from said vertical back hanger element, and a front peg element extending forwardly from said vertical front peg hanger element; said spine, hangers, and peg elements all being disposed in a common plane;

(b) a pair of horizontal side wires disposed in tandem and in association with said spine;

(c) said horizontal side wires each having vertical mounting legs depending from rearmost portions thereof;

(d) said vertical mounting legs being spaced from said back peg hanger element a predetermined distance substantially equal to the width of the pegbar;

(e) detent locking means formed integrally with lower portions of said mounting legs;

(f) a C-shaped bracket having a horizontal top wall and a horizontal bottom wall joined by a front wall;

(g) a first elongated slot formed in said top wall and a second elongated slot formed in said bottom wall; and (h) a vertical slot formed in said front wall; whereby (i) said peg wire may be mounted to said pegbar by superpositioning said C-shaped bracket over said pegbar, inserting said mounting legs through said first and second elongated slots to permit said detent locking means to engage said second elongated slot and to permit said vertical back hanger element to engage said vertical slot.

2. The peg assembly of claim 1, in which said vertical front hanger element and said vertical back hanger element are colinear.

3. The peg assembly of claim 1 in which said side wires are welded to said peg wire.

4. The peg assembly of claim 3 in which said side wires are joined to said peg wire at said vertical front hanger element and at said vertical rear hanger element.

5. The peg assembly of claim 1 in which one of said side wires is in the form of a label support and is bent to form an L-shaped label holder extending forwardly of said vertical front peg element.

6. The peg assembly of claim 1 in which (a) said side wires are formed from a single wire bent into a U-shape to establish a slide wire;

(b) a pair of sliding clips are welded to said spine; and (c) said sliding clips mount said peg wire to said slide wire for selective sliding movement therealong.

7. The assembly of claim 6 which further includes an I.D. wire joined to said mounting clips and extending forwardly of said peg wire for displaying a label forward of said front peg element.

* * * * *